US008747194B2

(12) United States Patent
Girrbach et al.

(10) Patent No.: US 8,747,194 B2
(45) Date of Patent: Jun. 10, 2014

(54) DEVICE FOR SINGULARISING COINS

(75) Inventors: Hugo Girrbach, Berlin (DE); Roland Griese, Berlin (DE); Christian Trenner, Berlin (DE)

(73) Assignee: Walter Hanke Mechanische Werkstätten GmbH & Co. KG, Berlin (DE)

( * ) Notice: Subject to any disclaimer, the term of this patent is extended or adjusted under 35 U.S.C. 154(b) by 1311 days.

(21) Appl. No.: 11/718,688

(22) PCT Filed: Nov. 21, 2006

(86) PCT No.: PCT/EP2006/011379

§ 371 (c)(1),
(2), (4) Date: Jan. 9, 2009

(87) PCT Pub. No.: WO2007/057233

PCT Pub. Date: May 24, 2007

(65) Prior Publication Data

US 2009/0215371 A1 Aug. 27, 2009

(30) Foreign Application Priority Data

Nov. 21, 2005 (DE) ..... 10 2005 056 191

(51) Int. Cl.

| | |
|---|---|
| ***G07D 1/00*** | (2006.01) |
| ***G07D 3/12*** | (2006.01) |
| ***G07D 3/06*** | (2006.01) |

(52) U.S. Cl.

CPC . *G07D 3/128* (2013.01); *G07D 3/06* (2013.01)
USPC ..... 453/49; 453/6; 453/12; 453/13; 453/57

(58) Field of Classification Search

CPC ..... G07D 3/128; G07D 9/008; G07D 3/14; G07D 3/16; G07D 3/02; G07D 3/06; G07D 3/00; G07D 3/10; G07D 9/065; G07D 3/04; G07D 9/00; G07D 1/00; G07D 9/04; G06M 7/04; G06M 3/02; F24F 3/00; A45C 1/02; G07F 1/047

USPC ..... 453/6, 10, 12, 13, 33–36, 49, 57

See application file for complete search history.

(56) References Cited

U.S. PATENT DOCUMENTS

| | | | | |
|---|---|---|---|---|
| 4,407,312 | A | | 10/1983 | Davila et al. |
| 4,561,457 | A | * | 12/1985 | Sasaki ..... 453/5 |
| 5,240,099 | A | * | 8/1993 | Brown et al. ..... 194/317 |
| 5,295,900 | A | * | 3/1994 | Tsuchida et al. ..... 453/57 |
| 6,039,643 | A | | 3/2000 | Kurosawa et al. |
| 6,210,264 | B1 | | 4/2001 | Richardson |
| 6,554,118 | B2 | | 4/2003 | Lim |

FOREIGN PATENT DOCUMENTS

| | | |
|---|---|---|
| CH | 3 21 704 | 8/1953 |
| DE | 36 27 387 | 2/1988 |
| FR | 2 650 417 | 2/1991 |

* cited by examiner

*Primary Examiner* — Jeffrey Shapiro
(74) *Attorney, Agent, or Firm* — Fay Kaplun & Marcin, LLP

(57) ABSTRACT

A device for singularising coins of different sizes and thickness with a housing which comprises an obliquely inclined base plate is suggested. A catch element for catching and conveying coins to a further processing is rotatably arranged above the base plate. The coins are randomly present at least in the lower region of the base plate on which a collection container is fastened. A flap is arranged in the base plate, which opens and closes synchronously with the driven coin catch element for leading a caught coin further.

18 Claims, 3 Drawing Sheets

DEVICE FOR SINGULARISING COINS

FIELD OF INVENTION

The present invention relates to a device for singularising coins.

BACKGROUND INFORMATION

In recent times, payment machines have been increasingly used for cashing in monies for purchased goods, which e.g. are placed at the tills of supermarkets or likewise, and into which the owed sum is added in the form of coins. The coins thereby, are filled into a receiver- or collection container in an uncontrolled and unsorted manner, whereupon they must be singularised and led to a coin tester. Thereby, the singularisation must be so reliable that a reliable transfer of only one coin is ensured, even with great differences in size and thickness.

A singularisation device for coin sorting- and/or coin counting machines is known from DE 40 09 087 A1, with which a hole disk rotatable on a base plate is arranged behind a receiver shell, wherein the coins are transported in the holes of the hole disk. Thereby, the base plate and the hole disk are arranged in an oblique manner. The holes of the hole disk in each case have the same diameter, and specifically such a diameter, which is slightly larger that that of the largest coin type to be processed. The thickness of the hole disk is generally such that the thicker coins of the hole disk slightly project beyond this. The counter plate at a certain height, merges into a recessed abutment surface, onto which the coins transported via the holes of the hole disk fall or slide, and are transported away by a conveyor member. A leaf spring is arranged in the upper region of this device in front of the hole disk, and this spring which lies directly opposite the hole disk, and inasmuch as this is concerned, acts as a deflector, thus coins which have not been singularised in a correct manner and project too far beyond the front side of the hole disk are displaced away.

SUMMARY OF INVENTION

The present invention relates to a device for singularising coins, which is simple in its construction, reliably ensures the singularisation with little design effort, and is inexpensive in manufacture.

By way of the fact that a flap is arranged in an obliquely inclined base plate, over which a catch element is provided for catching coins, said flap opening synchronously with the driven catch element for leading the caught elements further, one provides means by way of which a reliable singularisation of coins is possible.

The catch element is advantageously designed as a rotor with a hub and at least one blade, wherein the rotor rummages through the coins lying in a collection container in front of the base plate in a random manner, and catches the coins. By way of rummaging through the heap of coins by way of the rotor, the filling condition in the container is oblique, by which means coins falling down on rotation have space. The accommodation capacity may be increased in this manner.

A simple and thus inexpensive synchronisation of the flap with the catch element is achieved in that at least one projecting cam is arranged on the catch element, and this cam cooperates with a cam surface provided on the flap for the synchronous opening between the catch element and the flap.

It is advantageous for the rotor with the hub and at least one blade to be provided in the region of the hub with freeings for the coins to slide away. In this manner, surplus coins which are caught by the blade, fall back into the heap of coins without any disturbance.

It is particularly advantageous for an electrical control for the electric motor driving the catch element to be provided, which briefly stops the catch element in a position assigned to the flap, and then travels further or carries out one or more reversals in rotational direction between stoppage and continued travel, by which means a shaking or vibration of the catch element arises, since excess caught coins are shaken off or obtain an impulse, that causes them to fall back into the coin heap by way of this movement of the catch element.

It is advantageous for the flap, transversely to the rotational direction and, as the case may be, also to the counter rotational direction of the catch element, to be provided in each case with a ramp-like prominence, since on account of this measure, on the one hand again excess coins fall away downwards, and on the other hand the coins to be singularised are led cleanly into the opening slot between the flap and the base plate.

Finally, it is advantageous for the catch elements, in particular the rotor with blade(s), to comprises prominences or thickenings on its outer periphery, by which means, in particular with a few coins which are now present in the collection container, one prevents a dipping away, as the case may be, with edgewise coins, so that the last coin present in the collection container is also caught.

BRIEF DESCRIPTION OF DRAWINGS

One embodiment example of the invention is represented in the drawing and is explained in more detail by way of the subsequent description. There are shown in.

DETAILED DESCRIPTION

Figure 1:
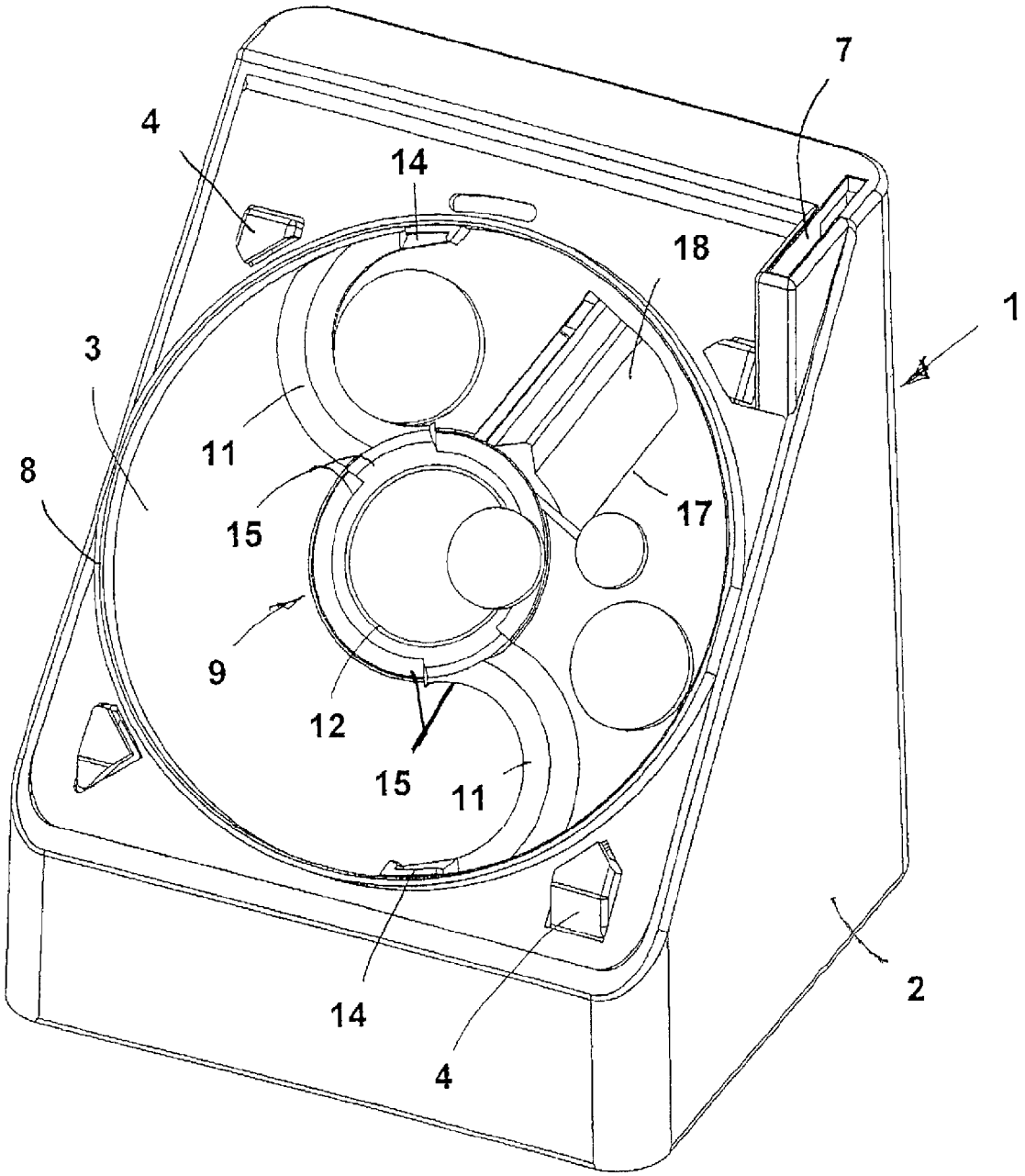
FIG. 1 shows a perspective view of one embodiment example of the device according to the present invention, for singularising coins, without a collection container.
Figure 2:
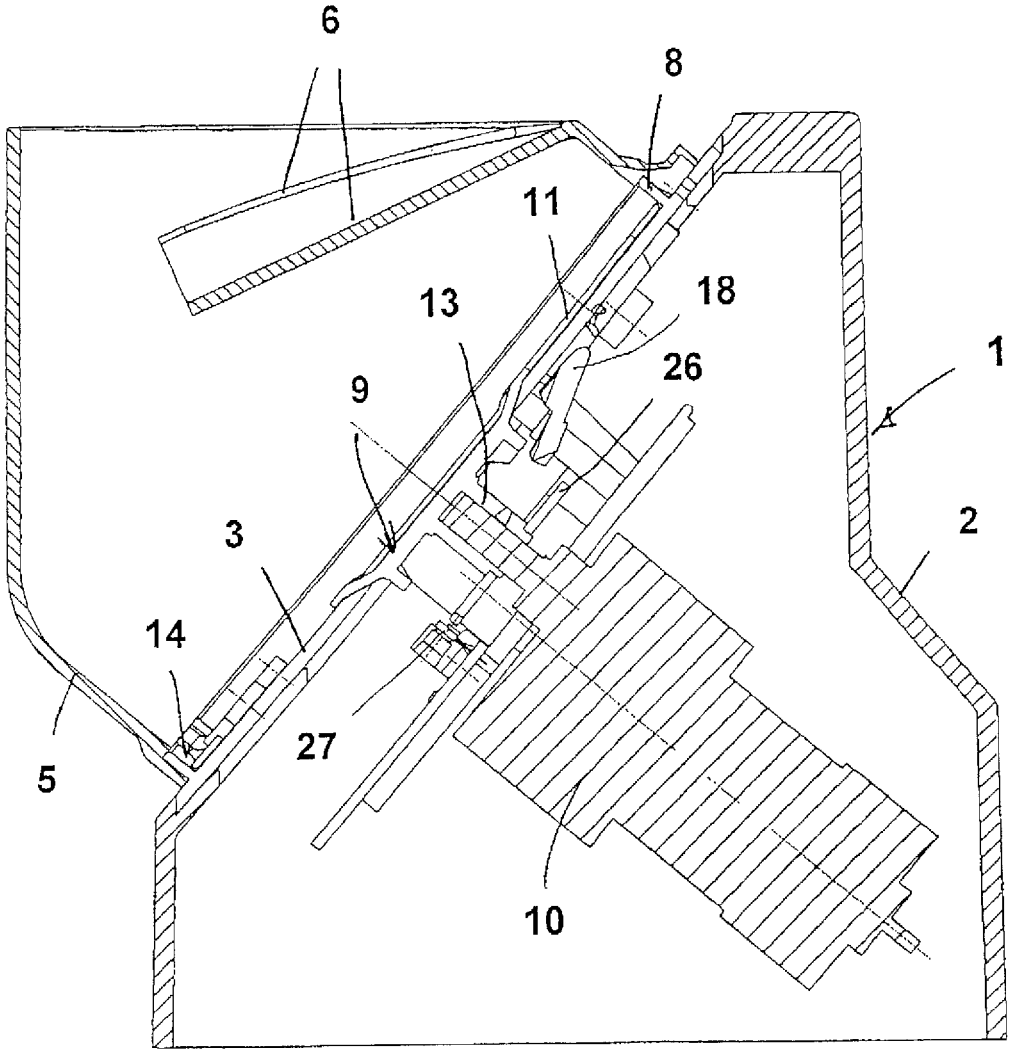
FIG. 2 shows a section through the device according to the present invention, according to FIG. 1, with a collection container top.
Figure 3:
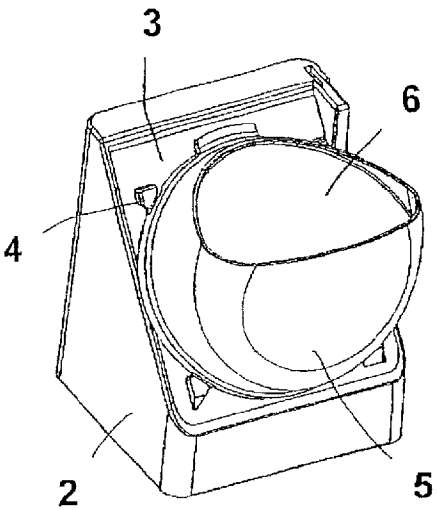
FIG. 3 shows a perspective view of the device according to the invention, with a collection container top.

The device according to the present invention represented in the FIGS. 1 to 3 comprises a housing 1 with a housing box 2 which is open at the bottom, a base plate 3 which is arranged obliquely on the housing box 2 and which is connected to the box 2 by way of locking- and/or snap connections 4, and a collection container top 5 which is connected to the base plate 3 and/or the housing box 2 likewise via locking- and/or snap connections. The collection container top has a deflection element 6 partly covering the opening. A slot 7 is incorporated in the box 2 which serves for the insertion of the coins.

The base plate 3 according to FIG. 1 and FIG. 2 is provided with a perpendicularly standing, annular peripheral wall 8, to which the collection container top 5 connects. Coins which have been inserted through the opening through the top 5 and deflected by the deflection element 6, are collected as a heap of coins in an irregular manner within the limitation by the collection container top 5 and the region in the base plate 3 which lies within the peripheral wall 8.

Figure 4:
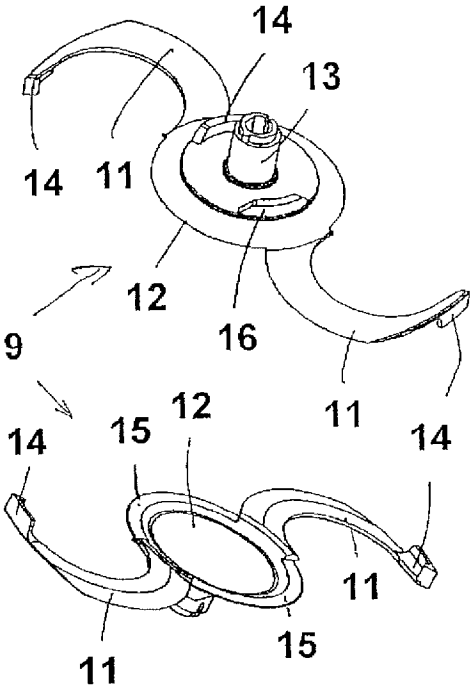

A circular opening with an oblique edge is provided in the base plate, in which a catch element designed as a rotor 9 is rotatable mounted. The rotor is firmly connected to the drive shaft of a gear motor 10, and on rotation, slides on the oblique edge region of the base plate 3. The rotor 9 comprises two curves blades 11 which are opposite one another, and which are attached onto a hub 12. The rotor is shown in more detail from above and below in FIG. 4. The hub 12 is closed to the top, i.e. in the direction of the collection container top 5, and at the opposite side comprises a lug 13 for receiving the motor shaft. The rotor 9 preferably consists of plastic, wherein the housing 1 too, i.e. the housing box, the collection container top 5 and the base plate 3 consist of plastic. The blades 11 which together form an S-shape, are provided at their ends with upwardly projecting lugs 14 which serve for ploughing through the coin heap present in the collection container 5. As may be recognised from FIG. 4, the hub 12 between the wings at least partly comprises freeings 15, i.e. in this region 15 the hub projects beyond the base plate 3 to a very small extent at the most. As may be recognised in FIG. 4 at the top, the hub at its side facing the d-c motor 10 comprises two lug-like cams 16 whose manner of functioning will be explained further below.

Figure 5:
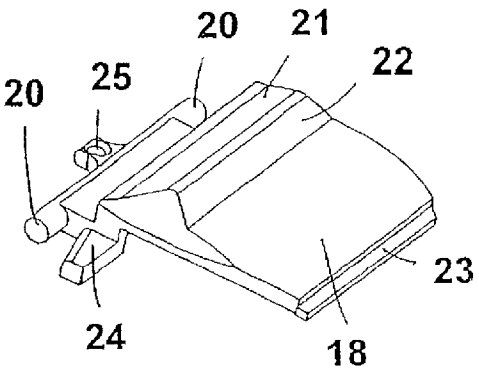
FIG. 4 shows a perspective view of the rotor from above and below and FIG. 5 shows a perspective view of the flap mounted in the base plate of the device according to the invention.

In the base plate 3, in the upper region of this between the peripheral wall 8 and the opening for the hub 12, a recess 17 is provided shortly next to the upper apexes of the base plate 3, into which a flap 18 engages, which is represented in more detail in FIG. 5. The flap 18 is rotatably mounted on the base plate 3 and/or a motor fastening arrangement 19 which is connected to the base plate via pivot lugs 20. The surface of the flap which projects essentially out of the base plate 3, comprises two ramp-like regions 21, 22 which rise obliquely in the rotational direction of the rotor 9 and in its counter-direction. Furthermore, the remaining surface is slightly curved, and specifically towards the edge which displays a step 23. The step 23 engages below the base plate 3 in a manner such that a continuous transition between the surface of the flap 18 and the surface of the base plate is present. A lug 24 is integrally formed laterally on the flap 18, and forms a cam surface which cooperates with the cam 16 attached onto the rotor 9, for opening the flap 18. As may now be recognised, an eye 25 is integrally formed at the rear end of the flap 18, into which the end of a return spring which is not shown, may engage, which after opening the flap 18 pulls this into the closure position. A path setter 26 which sets at least one fixed position of the rotor, is seated on the lug 13 of the rotor. This path setter is scanned by a sensor 27 which may be designed as an optical sensor, a Hall sensor given a metallic path setter 26, or as any other sensor. This sensor is connected to a control which is not shown, which controls the gear motor 10 for the drive of the rotor 9.

The control is characterised in that on starting the motor, the rotor 9 assumes a predefined starting position. This usefully lies shortly behind the flap 12, so that a coin may be transported already with the first half rotation of the rotor. For this, the predefined position is travelled to on stopping and switching off the rotor 9, wherein this predefined position is delivered depending on the signal of the sensor 7 in combination with the path setter 26, which may for example be designed as a toothed disk or segment disk. Usually, the predefined position as a starting position is searched and found by way of rotating the rotor 9 backwards after stoppage of the device.

An essential feature of the invention lies in the fact that the rotor briefly stops in a position in front of the flap with each revolution, and starts and stops again, and in each case carries out a direction reversal with a small amplitude once or several times, so that the rotor carries out a vibration- or shaking procedure shortly in front of the flap. Coins which are pulled along, on or in the region of the blades or wings 11, but do not lie in an ordered position to the flap 18, obtain one or more impulses by way of this shaking- or vibration procedure or only by way of a brief stoppage, by which means the coins are swiped away or flung away, and fall back onto the coin heap again.

The manner of functioning of the device is as follows: The device is switched on via an external signal, e.g. via a switch-on sensor which is arranged on the collection container top, wherein the rotor 9 is travelled into the start position which lies shortly behind the flap, after the preceding singularisation procedure. The rotor or the blades 11 of this rotor travels through the heap of coins, which is located in the lower region of the base plate 3 and of the collection container top 5, and catches one or more coins. In a position in front of the flap 18, the control controls the gear motor 10 to perform the shaking or vibration procedure, by which means the wing 11 is moved to and fro in a short manner, so that coins which are not held cleanly in the curvature of the blade are flung away. The rotor moves further in the direction of the flap and with its cam 16 which slides along the cam surface 24 of the flap 18, opens the flap 18 which dips downwards with respect to the base plate 3. The coin present in the curvature of the blade is pushed over the ramp-like region of the flap and then along the surface tilts into the slot-like opening between the flap and the base plate 3. When the rotor runs further over the flap, the cam 16 releases from the cam surface 24 and the flap is pulled closed, on account of the restoring spring which is not shown, and the procedure begins from afresh. In this manner, each coin of the coin heap is singularised, and even if the last coins are set edgewise with respect to the base plate, they are caught by the lugs 14 at the ends of the blades 11, so that the collection container is emptied down to the last coin. If the device is switched off, then the blade 11 or the rotor 9 continues to be rotated with the help of the path setter 26 and the sensor 27, until the start position is obtained. If the rotor on starting is not located in the start position, the position is searched in backward motion on switching on, in order not to produce an uncontrolled ejection of the coins. The shaking position is determined depending on the starting position, and the shaking is triggered by time-controlled movements.

The invention claimed is:

1. A device for singularising coins of different sizes and thickness with a housing, comprising:

a base plate inclined in an oblique manner;

a catch element catching and conveying coins for their further processing, rotatably arranged above the base plate, the coins being present in a random manner at least in a lower region of the base plate;

a flap arranged in the base plate and opening and closing synchronously with the driven catch element for the reliable transfer of a caught coin; and at least one projecting cam arranged on the catch element, the at least one projecting cam cooperating with a cam surface provided on the flap, for the synchronous opening and closing between the catch element and the flap, wherein the flap dips obliquely below the base plate.

2. A device according to claim 1, further comprising:

a collection container randomly receiving the different coins and is arranged on the housing.

3. A device according to claim 1, wherein the catch element is rotatably supported in the base plate.

4. A device according to claim 1, wherein the opening plane of the flap is directed obliquely downwards with respect to the base plate.

5. A device according to claim 1, wherein the catch element is designed as a rotor with a hub and at least one blade.

6. A device according to claim 5, wherein the hub is provided with cutaways for the slipping-away of coins.

7. A device according to claim 1, wherein the flap comprises a first ramp-like prominence rising obliquely along a rotational direction of the catch element and a second ramp-like prominence rising obliquely along a counter-rotational direction.

8. A device according to claim 1, wherein the catch element for its rotation is connected to an electric motor which is connected to a control.

9. A device according to claim 8, wherein the control includes at least one sensor arrangement which determines a position of the catch element.

10. A device according to claim 8, wherein the control is designed in a manner such that the catch element briefly stops in a position allocated to the flap and then continues to move.

11. A device according to claim 10, wherein at least one rotational direction reversal takes place within a short period of time, between a brief stoppage and continued travel.

12. A device according to claim 10, wherein several rotational direction reversals take place within a short period of time, between a brief stoppage and continued travel.

13. A device according to claim 1, further comprising:

a switch-on sensor allocated to the collection container.

14. A device according to claim 1, wherein the catch element includes one of prominences and thickenings on its outer periphery.

15. A device according to claim 1, wherein the rotor with blades includes one of prominences and thickenings on its outer periphery.

16. A device according to claim 8, wherein the electric motor is designed as a gear motor.

17. A device according to claim 1, wherein the rotor consists of plastic.

18. A device according to claim 1, wherein the housing, base plate and collection container are put together with at least one of a locking-connection and a snap connection.

* * * * *